US005204658A

United States Patent [19]

Beauquey

[11] Patent Number: 5,204,658

[45] Date of Patent: Apr. 20, 1993

[54] STRUCTURE FOR A DOOR INCLUDING A DISPLAY DEVICE

[75] Inventor: Joel Beauquey, Chenevrey, France

[73] Assignee: Schlumberger Industries, Montrouge, France

[21] Appl. No.: 741,193

[22] Filed: Jul. 30, 1991

Related U.S. Application Data

[63] Continuation of Ser. No. 263,167, Oct. 28, 1988, abandoned.

[30] Foreign Application Priority Data

Nov. 19, 1987 [FR] France ..... 87 15994

[51] Int. Cl.[5] ..... G09G 5/00

[52] U.S. Cl. ..... 340/700; 340/711; 361/380; 341/22

[58] Field of Search ..... 340/700, 932.2, 706, 340/711, 712; 235/381; 200/5 R; 341/22, 23; 194/350; 221/8, 155, 282, 129, 130, 131, 133; 361/380

[56] References Cited

U.S. PATENT DOCUMENTS

| | | | |
|---|---|---|---|
| 3,941,977 | 3/1976 | Voss et al. | 235/381 |
| 4,022,993 | 5/1977 | Shattuck | 341/23 |
| 4,134,537 | 1/1979 | Glaser et al. | 235/381 |
| 4,359,631 | 11/1982 | Lockwood et al. | 235/381 |
| 4,532,575 | 7/1985 | Suwa | 200/5 R |
| 4,784,252 | 11/1988 | Davis | 194/350 |
| 4,818,854 | 4/1989 | Davies et al. | 235/381 |
| 4,858,743 | 8/1989 | Paraskevakos et al. | 235/381 |

*Primary Examiner*—Alvin E. Oberley
*Assistant Examiner*—Richard Hjerpe
*Attorney, Agent, or Firm*—Frishauf, Holtz, Goodman & Woodward

[57] ABSTRACT

A structure for a door including a display device, in particular for machines actuated by the insertion of coins. The structure comprises an outer door (40) provided with a window (72) and with orifices (74) having key extensions (80) mounted therethrough, together with a backing door (42). The backing door carries a display (60), an electronic circuit (56, 62), a keypad constituted by keypad switches (66), and a switch (64) which remains inaccessible from the outside when the outer door (40) is closed, whereas key extensions (80) pass through the outer door (40) to enable the keypad to be actuated when the outer door (40) is closed.

7 Claims, 5 Drawing Sheets

STRUCTURE FOR A DOOR INCLUDING A DISPLAY DEVICE

This application is a continuation of application Ser. No. 07/263,167, filed Oct. 28, 1988, now abandoned.

The present invention relates to a structure for a door including a display device, in particular a door for machines actuated by inserting coins.

BACKGROUND OF THE INVENTION

There exist numerous machines, and in particular machines actuated by the insertion of coins, tokens, or similar items, where the machine includes a housing closed by a front door. The door includes various items, in particular items required for receiving coins and for issuing a ticket, etc., in return, and also display devices, e.g. liquid crystal devices or filament devices. In normal use, the display system serves to provide a user with a certain amount of information, in particular concerning the actions that need to be performed in order to obtain a given service or on the amount of money that still needs to be inserted into the machine prior to the service being delivered.

Inside the housing of the machine, there are various components, including those which serve for delivering goods or services after money or money's worth has been inserted, and also various electronic circuits for controlling the machine overall. These electronic circuits which control the operation of the machine, e.g. issuing a ticket in response to coins being inserted up to a predetermined amount, make use of various different parameters. For example, for a parking meter, one of the parameters is the price of a parking unit, or in a machine which delivers various different types of goods, one of the parameters is the price of the goods selected by the user. Clearly it is necessary for operatives to be able to change these parameters during maintenance operations in order to adapt a machine to new operating conditions. However, it is also essential to ensure that the means for modifying these parameters are not accessible to users.

In order to understand the problem which the present invention seeks to solve, reference is made to accompanying FIGS. 1 and 2 which are simplified diagrams respectively of the front face of a dispenser of tickets for pay car parking, and a horizontal section through the front face on a line II—II in FIG. 1. FIG. 1 shows a door 10 mounted in the front face of the housing 12 of the machine by means of hinges 14 and 16. The door 10 essentially includes a display system 18, e.g. of the liquid crystal type or of the filament type, a coin slot 20, a slot 22 for issuing printed tickets, a coin return chute 24, and various pushbuttons such as 26 enabling a user to select various different machine functions.

With reference now to FIG. 2, it can be seen that the door 10 which provides mechanical protection for the housing also includes a window 30 with the display device 18 per se being disposed behind the window. The inside face of the door 10 also carries various electronic circuits 32 and a controlling keypad 34. The keypad 34 is used, in particular, during commissioning or maintenance operations for programming the circuits 32 so that the machine provides the required services, for testing the operation of the machine, or for obtaining various items of statistical information concerning machine utilization.

The results of tests or of keying-in new parameters or of making adjustments to the machine can be checked solely by observing the information which appears on the display 18. It will readily be understood that with the prior art configuration shown in FIGS. 1 and 2, it is difficult to check adjustments in this way since the displayed information can be seen only from in front of the door whereas the items used for making the adjustments, i.e. the keypad 34, are to be found on the back face of the door. It should be recalled that it is essential for the display system 18 to be visible from the outside since it serves in normal use for providing users with information, and that the controlling keypad 34 must necessarily be on the inside face of the door in order to prevent unauthorized users from changing the operating parameters of the machine.

In order to remedy these drawbacks, an object of the invention is to provide a structure for a door including a display device, in particular for machines actuated by inserting coins, which enables maintenance, tests, or adjustment operations to be performed under conditions which are improved over those described above.

SUMMARY OF THE INVENTION

This object is achieved, according to the present invention, by a structure for a door including a display device, in particular for a machine actuated by the insertion of coins, the structure comprising:

an outer door having mechanical strength and provided with a transparent window; and a backing door pivotally mounted on said outer door and facing the inside face thereof, said backing door being provided with a display device disposed on the outside face of the backing door so as to appear behind said window when said backing door is applied against said outer door, command input members being disposed on the outside face of the backing door together with an electronic circuit suitable for receiving said commands and for controlling said display device in order to cause it to display information in response to said commands being input.

It will be understood that by virtue of the invention, the display is visible from the outside for a user even though the display and the control input members, e.g. the keypad, for use in adjusting or testing the machine are to be found on the same face of the backing door. Thus, in order to perform maintenance and adjustment operations, it is merely necessary to open the outer door, while leaving the backing door in place.

BRIEF DESCRIPTION OF THE DRAWINGS

Embodiments of the invention are described by way of example with reference to the accompanying drawings, in which.

MORE DETAILED DESCRIPTION

Figure 3:
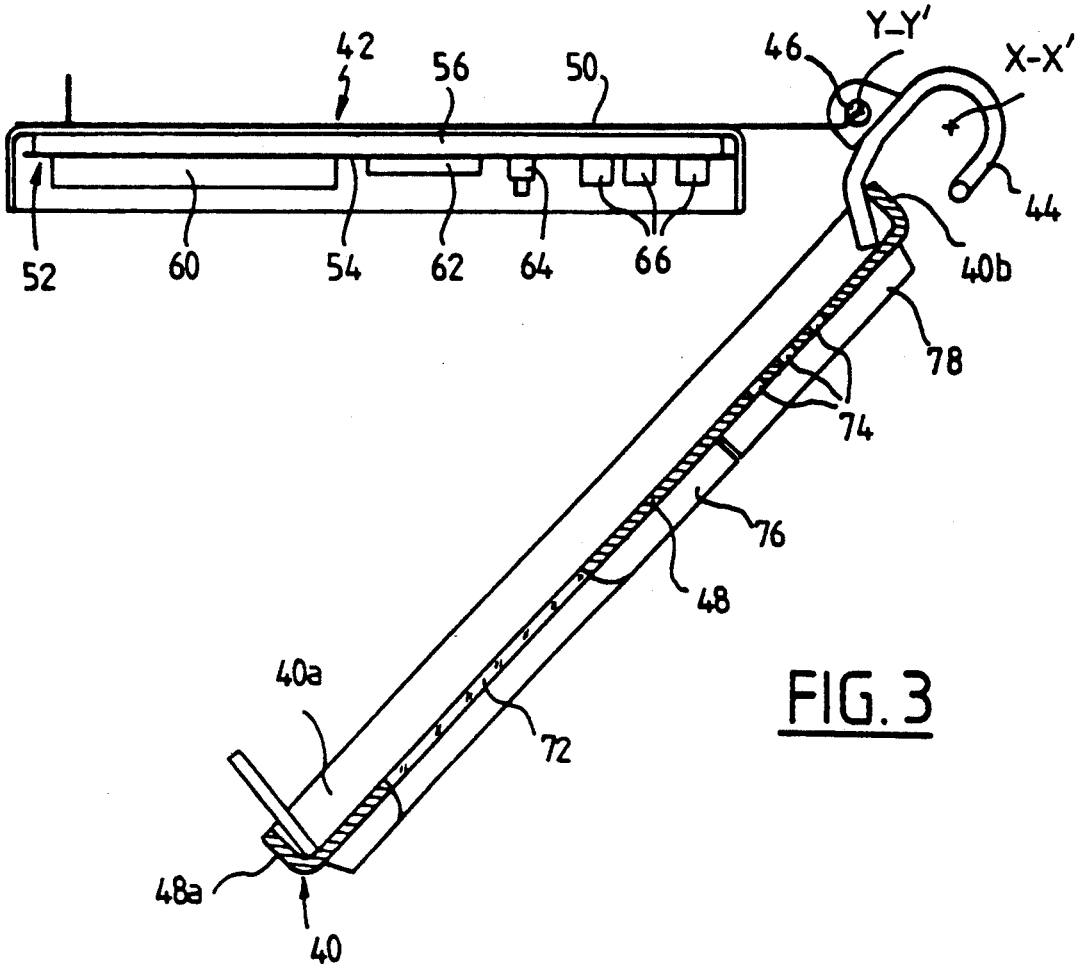
FIGS. 3 and 4 show an embodiment of a door structure in accordance with the invention respectively in a maintenance position and in a utilization position.
Figure 4:
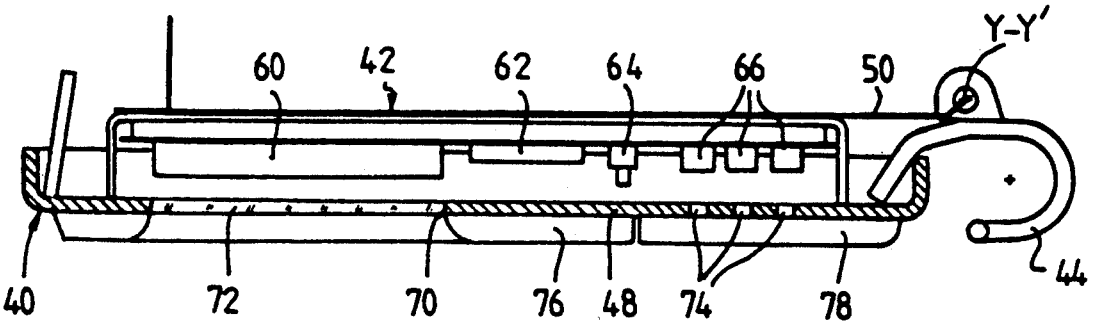

Reference is now made to FIGS. 3 and 4 for describing a first embodiment of a door structure in accordance with the invention.

The door structure is constituted by an outer door 40 together with a backing door 42, with the backing door being disposed facing the inside face 40*a* of the outer door 40. The edge 40*b* of the outer door 40 is provided with assembly components such as 44 for assembling the door to the housing of the machine of which the door forms a part. The backing door 42 is mounted on the outer door 40 by pivot systems such as 46. As a result, the backing door 42 may pivot about an axis Y—Y' relative to the outer door 40, with the axis Y—Y' being parallel to the axis X—X' about which the outer door 40 pivots relative to the housing.

The outer door 40 includes a wall 48 constituted, for example, by metal sheet of adequate thickness and having a folded back rim 48*a*. It is the wall 48 of the door 40 which provides the mechanical strength of the door structure and which thus serves to protect the machine against acts of vandalism.

The backing door 42 includes a support element 50 having an electronics card 52 fixed thereon. The electronics card 52 includes an insulating support 54 on which the electronic circuits are fixed and appropriately interconnected. This assembly is given an overall reference 56. The outside face of the insulating support 54 carries a display device 60, e.g. a liquid crystal display device, a memory circuit 62, a control switch 64, and microswitches 66. The switches 66 are disposed in lines and columns in order to constitute a keypad. The electronic circuit 56 and its electrical or electronic components 60 to 66 are interconnected, for example by conducting tracks made on the insulating support 56. The circuits 56 and the memory 62 are organized and programmed so as to control the operation of various members disposed inside the machine on which the door structure is mounted, and also to control the operation of the display device 60. The particular functions performed by these circuits naturally depend on the type of machine on which the door structure is fitted. However, it may be mentioned that the control switch 64 serves to put the set of circuits into a normal operation state or into a test or control state. The microswitches 66 serve, when the switch 64 is placed in its test or control position, to modify the operating parameters of the circuits, to test the values of said parameters, and to cause said values to appear on the display device 60, or even to cause the machine to operate temporarily in a special mode.

Returning to the outer door 40, it can be seen that the wall 48 has a first opening 70 therethrough which is closed by a glass 72, and a plurality of small-sized orifices 74. As can be seen more clearly in FIG. 4, when the backing door 42 is applied against the outer door 40, the display device 60 faces the glass 72, while each of the orifices 74 faces one of the switches 66. External cover plates 76 and 78 mounted on the outside face of the wall 48 serve to mask the orifices and to give the desired appearance to the outer door 40.

Figure 1:
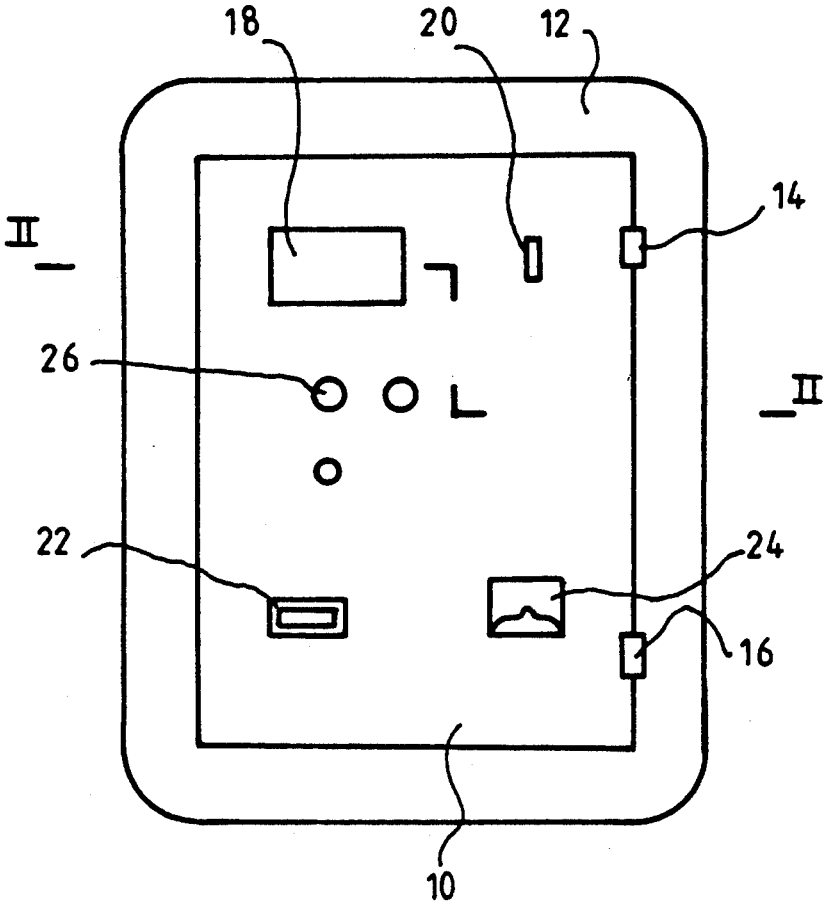
FIGS. 1 and 2 are described above and respectively show the front face of the housing of a machine controlled by the insertion of coins, and a horizontal section through the door of such a machine.
Figure 2:
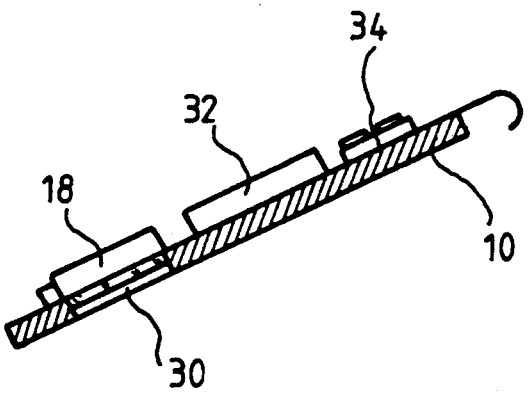

When the door structure is closed (FIG. 4), the backing door 42 is applied against the outer door 40. The switch 64 and the switches 66 are masked by the wall 48 and the display device 60 is visible from the outside through the window 72. So far as the user is concerned, the machine appears exactly like the prior art machines shown in FIG. 1.

When an operative seeks to test the machine or to change its adjustments, the door structure is unlocked with the outer door 40 being opened while the backing door 42 is left in the position it occupied while the door structure was closed. This gives the operative direct access to the control switch 64 and to the microswitches 66. The desired tests and adjustments can thus be performed while the display device 60 remains easily visible for showing the effects of the adjustments or the results of the tests. When these operations have been completed, the operative returns the control switch 64 into a position which corresponds to normal operation and then closes and locks the outer door 40, thereby simultaneously locking the backing door 42.

Figure 5:
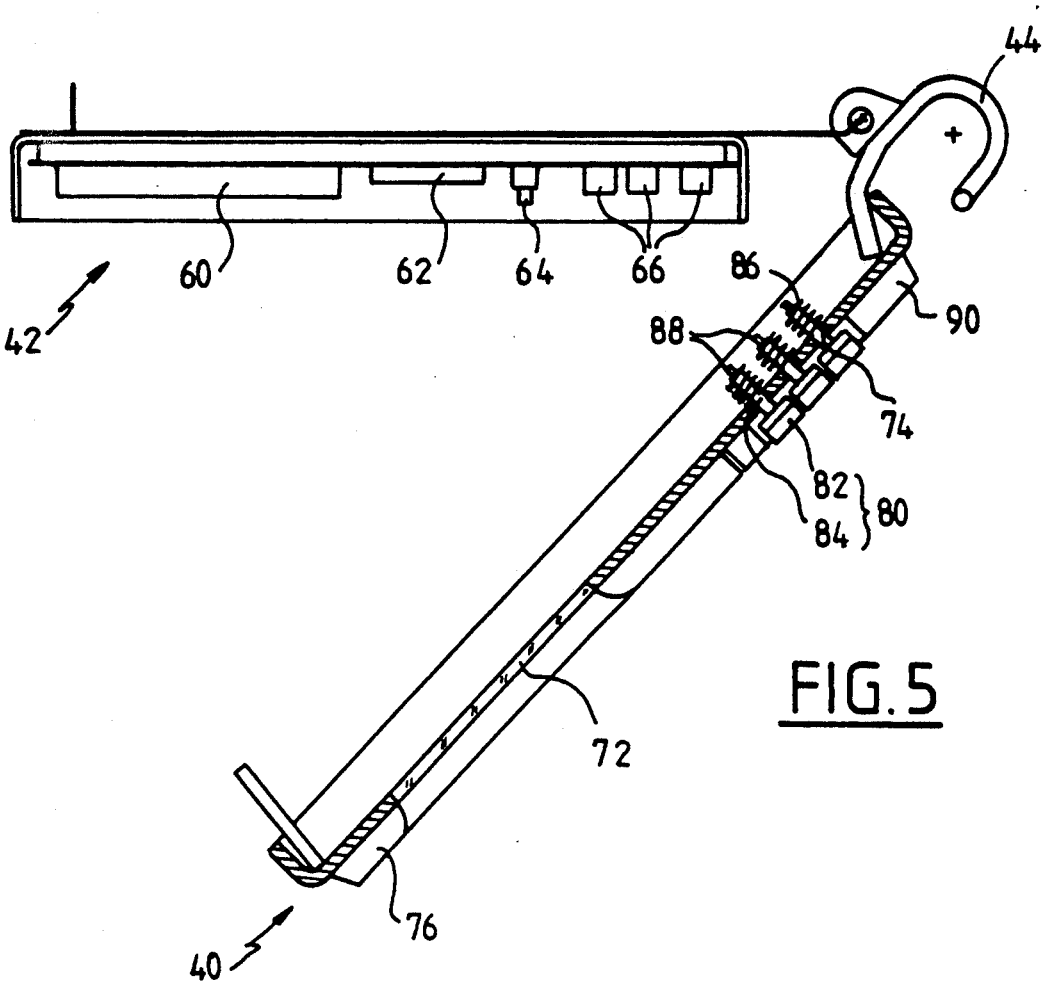
FIGS. 5 and 6 show a door structure in accordance with the invention respectively in a maintanance position and in a utilization position for the case where the door includes a keyboard which is accessible from outside.
Figure 6:
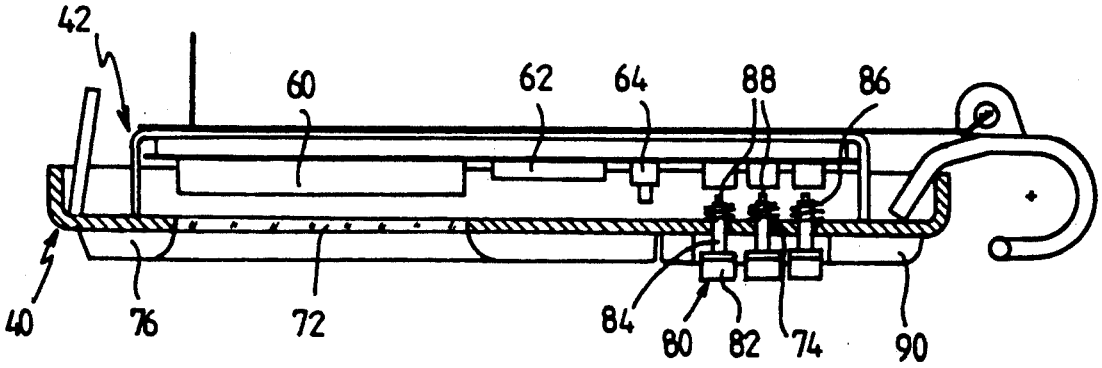

FIGS. 5 and 6 show a variant embodiment of the door structure when the door needs to include a keyboard which is accessible to users for controlling the operation of the machine. The only modification over the embodiment shown in FIGS. 3 and 4 consists in adding an external keypad. More precisely, key extensions such as 80 are mounted in the orifices 74 of the wall 48 of the outer door 40. Each of the key extensions comprises a head 82 and a plunger 84 slidably mounted in the orifice 74 and engaged with resilient return means 86. The end 88 of each extension 80 is capable of actuating the corresponding switch 66 when the user presses the head 82 of the corresponding extension. Naturally, in this case, cover plate 78 shown in FIGS. 3 and 4 is replaced by a cover plate 90 which surrounds the keypad constituted by the heads 82 and the extensions 80.

It can thus be seen, that by virtue of the invention, it is possible to use a single door structure for both embodiments, with the difference between the structure being due solely to the addition or the omission of external key extensions. Further, the control switch 64 remains inaccessible to users who are therefore prevented from fraudulently modifying machine operation. In this embodiment, when an adjustment or a test is to be performed, the operative opens the outer door 40, puts the control switch 64 into the "adjustment or test" position and proceeds with the necessary operations by means of the switches 66 as explained above. When finished, the control switch 64 is returned to its "normal operation" position, the door 40 is closed and then locked. The machine is again ready to be used by users.

Figure 7:
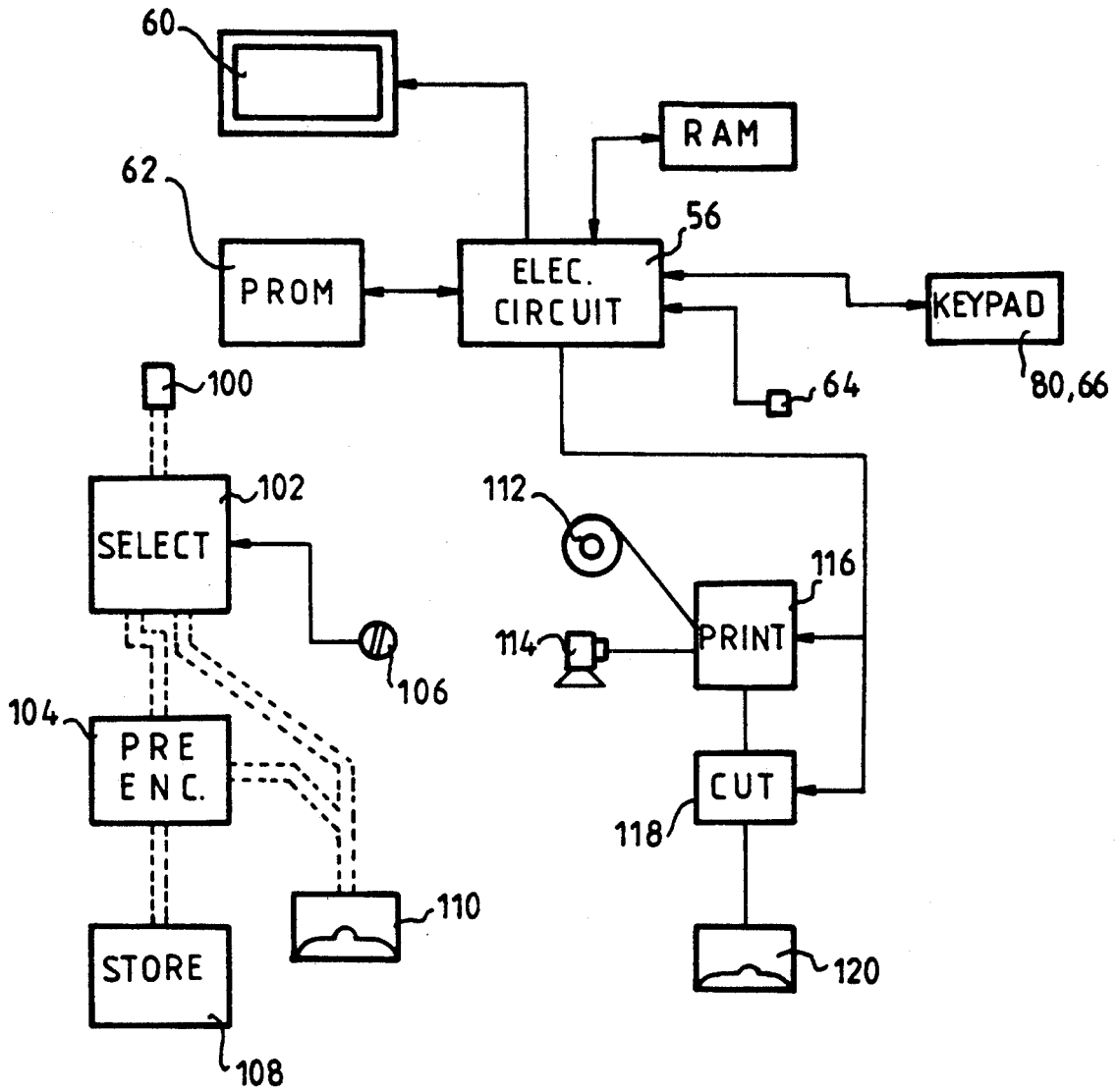
FIG. 7 is a block diagram showing the organization of a ticket-dispensing machine.
Figure 8:
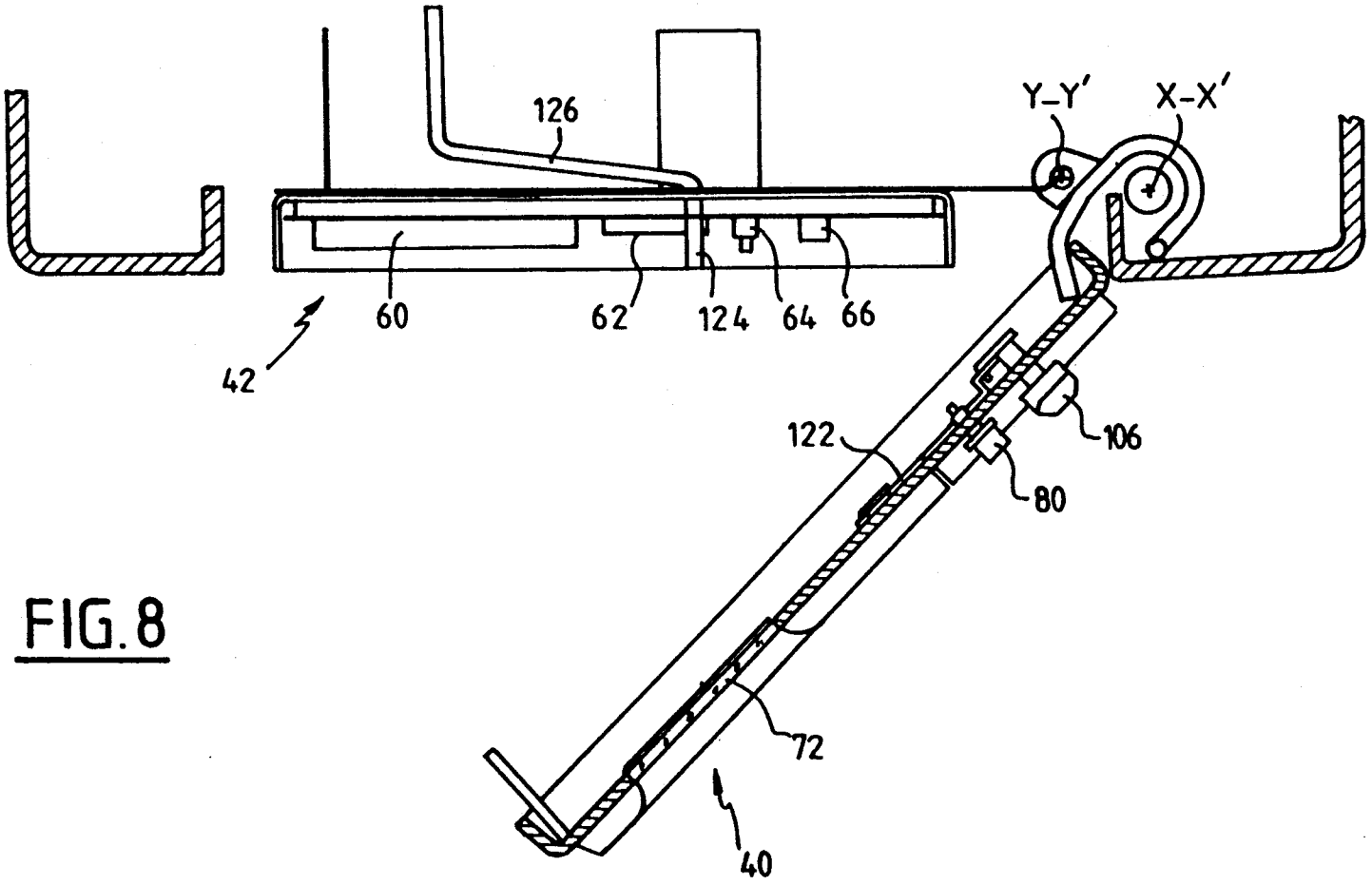
FIG. 8 shows a door structure in accordance with the invention adapted to the ticket-dispensing machine shown in FIG. 7.

Reference is now made to FIGS. 7 and 8 for describing an application of the door structure to a machine for dispensing tickets.

FIG. 7 shows the various functional parts of a coin machine for use in a pay car park. The coin circuit includes a coin slot 100 provided in the outer door of the door structure, a coin selector 102 fixed to the backing door, a pre-encashing device 104 controlled by a "valid" button 106, a receptacle 108 for storing accepted coins, and a coin return chute 110 provided in the outer door. This coin circuit is entirely conventional for such machines and therefore does not need to be described in greater detail. It also includes a display mounted on the backing door. The machine also includes a ticket-dispensing circuit including a reel of paper on which tickets can be printed, a motor 114 for driving the reel of paper, a printhead 116, e.g. of the thermal type, for putting special mentions on each ticket, a cutter 118 for separating a printed ticket from the remainder of the reel, and a ticket outlet 120 provided in the outer door.

The set of functions described above are controlled by an electronic circuit 56 associated with a working memory RAM mounted in the backing door and a non-volatile (PROM) memory 62 for storing the program and other data, the PROM 62 being also mounted in the backing door 42. Finally, the machine includes a keypad constituted by the switches 66 and by the key extensions 88 which are respectively mounted on the backing door and in the outer door as explained above, together with the control switch 64 which is mounted on the backing door.

FIG. 8 shows various mechanical details related to the fact that the door structure comprises both an outer door 40 and a backing door 42. The coin return button 106 is mounted in the outer door 40. It controls rodding 122 which is mounted on the inside face of the wall 48. This rodding 122 cooperates, when the door 40 is closed, with the end 124 of a lever 126 which is pivotally mounted in the backing door 42. The other end of the lever 126 acts on a cam of the selector 102 and indirectly on the pre-cashing device 104 in order to cause the coins to be returned when the button 106 is actuated.

I claim:

1. A door structure for a machine housing, said structure comprising:

an outer door pivotally mounted on said housing and adapted for moving between a closed position to shut off the interior of said housing from the outside and an open position exposing the interior of said housing, said outer door having an inside face which is turned toward the interior of said housing when the outer door is in its closed position, said outer door including a transparent window, said outer door and said window being adapted to protect said machine against acts of vandalism when said outer door is in its closed position and locked to said housing, said outer door being locked when said machine is in normal use, said machine comprising a backing door, a display device, and manually actuatable command input means; and said backing door being pivotally mounted relative to said outer door and said housing, said backing door having an outside face wherein, when the outer door is in its closed position, the outside face of said backing door faces the inside face of said outer door, and an inside face of said backing door faces the interior of said housing;

said display device being disposed on the outside face of the backing door so as to appear behind said window when said backing door is positioned against said outer door, said display device including means to display information in relation to the operation of said machine;

electronic circuit means fixed to one face of said backing door for controlling the operation of said machine; and said manually actuatable command input means being disposed on the outside face of said backing door for applying commands to said electronic circuit means only when said outer door is in its said open position, said electronic circuit means causing the display device to display information in response to the input of at least some of said commands.

2. A door structure according to claim 1, wherein said backing door is mounted on said outer door.

3. A door structure according to claim 1, wherein said command input means comprise a plurality of switches constituting a keypad.

4. A door structure according to claim 3, wherein said outer door includes a plurality of orifices with each orifice being disposed facing one of said switches when said outer door is positioned against said backing door.

5. A door structure according to claim 4, further comprising a plurality of key extensions, with each extension being mounted in one of said orifices, with first ends of said extensions constituting a second keypad accessible from outside the housing and with the second ends of said extensions being suitable for respectively actuating said switches under the effect of pressure exerted on their said first ends when said backing door is positioned against said outer door.

6. A door structure according to claim 3, in which said backing door further includes manually actuatable test means for modifying the effects of said switches as a function of the position of said test means.

7. A door structure for a machine housing, said structure comprising:

an outer door pivotally mounted on said housing and adapted for moving between a closed position to shut off the interior of said housing from the outside and an open position exposing the interior of said housing, said outer door having an inside face which is turned toward the interior of said housing when the outer door is in its closed position, said outer door being adapted to protect said machine against acts of vandalism when said outer door is in its closed position and locked to said housing, said outer door being locked when said machine is in normal use; and a backing door pivotally mounted relative to said outer door, said backing door having an outside face wherein, when the outer door is in its closed position, the outside face of said backing door faces the inside face of said outer door, and an inside face of said backing door faces the interior of said housing, whereby said backing door is protected when said outer door is locked to said housing;

electronic circuit means located within said machine housing; and a plurality of switches constituting a keypad disposed on the outside face of said backing door for applying commands to said electronic circuit means, said outer door being provided with a plurality of orifices respectively disposed facing said plurality of switches when said outer door is applied against said backing door; and a plurality of key extensions respectively movably mounted in said plurality of orifices, each of said plurality of key extensions having opposite ends with one of said ends of said extensions constituting a second keypad accessible from outside the outer door and with the other of said ends of said extensions being adapted to respectively actuate said plurality of switches under the effect of pressure exerted on their one ends when said backing door is applied against said outer door.

* * * * *